US007758270B2

(12) United States Patent
Aebischer

(10) Patent No.: US 7,758,270 B2
(45) Date of Patent: Jul. 20, 2010

(54) INK REFILL TOOL FOR A WRITING INSTRUMENT

(75) Inventor: Robert Aebischer, Corminboeuf (CH)

(73) Assignee: Cartier Creation Studio S.A., Geneva (CH)

( * ) Notice: Subject to any disclaimer, the term of this patent is extended or adjusted under 35 U.S.C. 154(b) by 0 days.

(21) Appl. No.: 12/099,333

(22) Filed: Apr. 8, 2008

(65) Prior Publication Data

US 2009/0252547 A1 Oct. 8, 2009

(51) Int. Cl.
*B43K 1/00* (2006.01)
*B43K 29/00* (2006.01)
*B43K 5/00* (2006.01)

(52) U.S. Cl. ..... 401/292; 401/195; 401/251

(58) Field of Classification Search ..... 401/195, 401/251, 292
See application file for complete search history.

(56) References Cited

U.S. PATENT DOCUMENTS

| | | | | |
|---|---|---|---|---|
| 2,658,479 | A | 11/1953 | Fried | |
| 3,127,647 | A | 4/1964 | Helitas | |
| 3,830,574 | A * | 8/1974 | Glombitza et al. | 401/195 |
| 4,455,101 | A | 6/1984 | Malamoud | |
| 4,560,298 | A | 12/1985 | Oki et al. | |
| 4,753,546 | A * | 6/1988 | Witz et al. | 401/258 |
| 4,892,428 | A * | 1/1990 | Grotsch | 401/258 |
| 4,952,088 | A * | 8/1990 | Groetsch | 401/195 |
| 4,981,383 | A * | 1/1991 | Grotsch et al. | 401/195 |
| 5,061,105 | A | 10/1991 | Isoda | |
| 5,336,011 | A | 8/1994 | Ferguson et al. | |
| 5,533,824 | A * | 7/1996 | Heidenreiter et al. | 401/133 |
| 5,781,979 | A | 7/1998 | Andrews | |
| 6,186,687 | B1 | 2/2001 | Fuchs et al. | |
| 2005/0020989 | A1 * | 1/2005 | Pommereau et al. | 604/263 |
| 2005/0191114 | A1 | 9/2005 | Smith, Jr. et al. | |
| 2006/0080846 | A1 | 4/2006 | Luttgens | |

FOREIGN PATENT DOCUMENTS

| | | | |
|---|---|---|---|
| DE | 4407153 | | 9/1995 |
| DE | 102005032548 | | 1/2007 |
| EP | 0224404 | | 6/1987 |
| JP | 11208183 | | 8/1999 |
| JP | 11254882 | | 9/1999 |
| JP | 2002326495 | | 11/2002 |
| JP | 2005161668 | | 6/2005 |
| JP | 2005193637 | | 7/2005 |
| JP | 2007112032 | | 5/2007 |
| WO | WO 2006/075064 | * | 7/2006 |

* cited by examiner

*Primary Examiner*—Gregory L Huson
*Assistant Examiner*—Ryan A Varnum
(74) *Attorney, Agent, or Firm*—Young & Thompson

(57) ABSTRACT

A tool facilitates the insertion and removal of an ink reservoir unit, such as a cartridge, from a chamber of a writing instrument. The chamber is located within a drum that is coupled to a nib of the writing instrument. The tool comprises a main section defining, at least in part, an internal cavity for receiving the nib. The tool is configurable in a closed state, in which the nib is positioned inside the cavity and the tool clutches a grip portion of the writing instrument that is rigidly coupled to the nib and the drum. The tool is further configurable in an open state in which the cavity is partially open, compared to when the tool is in the closed state, thereby facilitating safe placement of the nib inside the cavity.

13 Claims, 3 Drawing Sheets

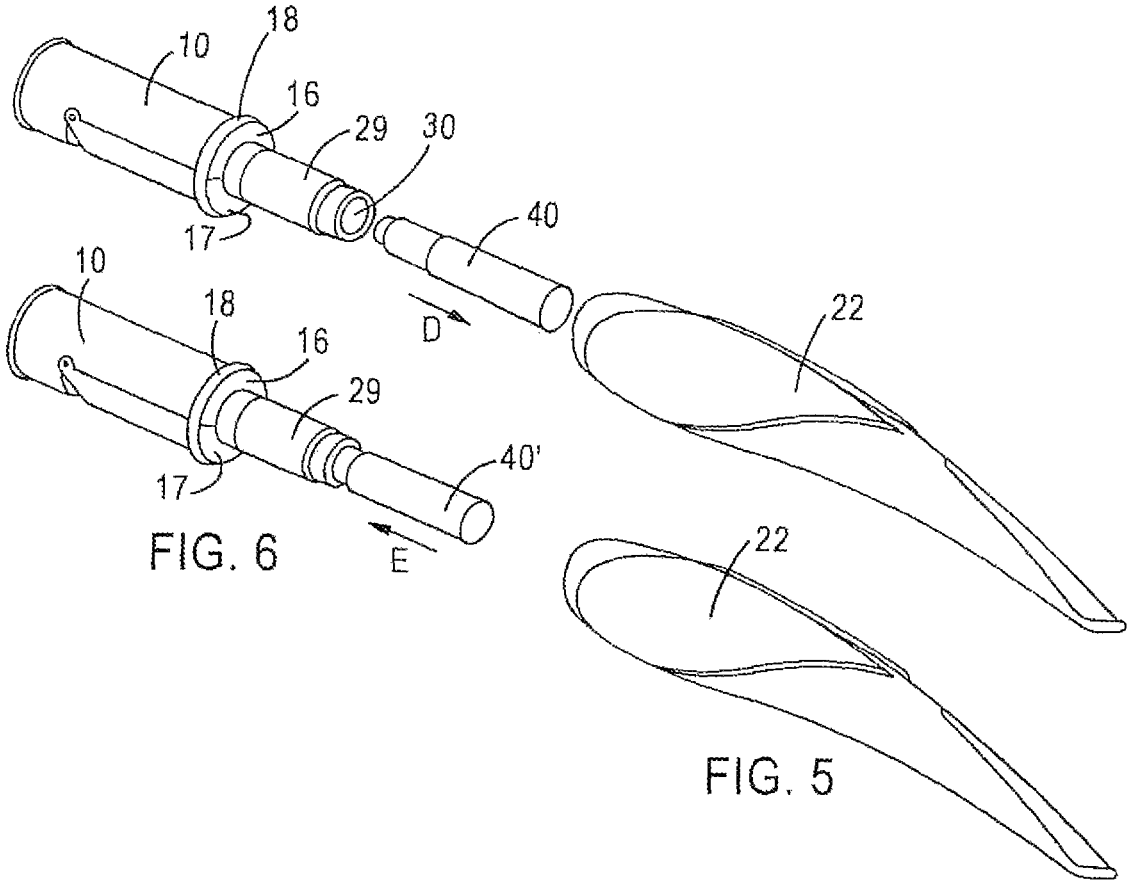
FIG. 6
FIG. 5
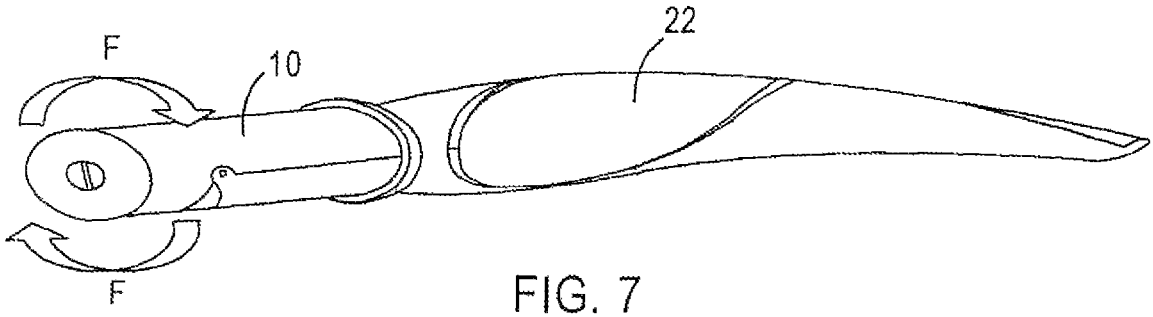
FIG. 7
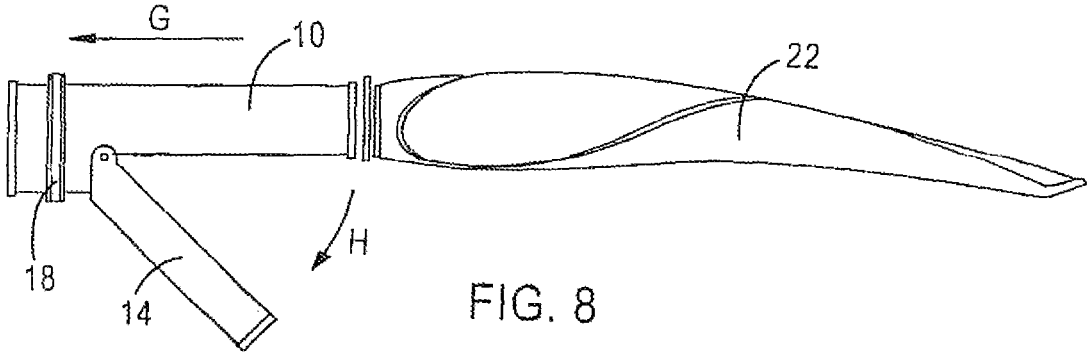
FIG. 8

INK REFILL TOOL FOR A WRITING INSTRUMENT

FIELD OF THE INVENTION

The present invention relates to a tool for facilitating the replacement and/or refilling of ink in a writing instrument, such as the insertion and extraction of ink cartridges in a fountain pen.

BACKGROUND OF THE INVENTION

A fountain pen is a writing instrument that uses liquid ink stored in a refillable or replaceable reservoir. The ink is generally fed from the reservoir to the pen's nib through a combination of capillary action and gravity.

As is well known, a large number of fountains pens use disposable ink cartridges as their ink source. An ink cartridge is typically sealed by a small ball that blocks the cartridge's ink flow hole until the cartridge is firmly inserted into a reservoir chamber within the pen, whereby a small pin pushes in the plastic ball and enables the ink to flow into the pen's ink feed system. When the ink from a cartridge has been exhausted, it is simply removed and replaced by a new one. Ink cartridges are popular because of their convenience, and many fountain pen manufacturers have ensured that standardized cylindrical-shaped ink cartridges in one (or both) of two sizes—a short cartridge approximately 38 mm in length and 0.75 ml in capacity and a long cartridge approximately 72 mm in length and 1.45 ml in capacity—are compatible with their pens.

In many cases, a converter may also be used in place of an ink cartridge. Converters generally are of the same size as an ink cartridge but also have a filling mechanism (typically screw or piston-based) attached to their reservoirs, thereby allowing them to be refilled from a bottle of ink. The use of converters is therefore normally more economical and environmentally friendly, and it may also enable a greater selection of inks to be used.

In many fountain pens, the ink reservoir chamber within the barrel is accessed by unscrewing, or otherwise separating, the nib from the barrel. In such cases, the insertion and extraction of cartridges and converters from the pen's barrel is often awkward for a user and may additionally leave ink marks on the user's hands. Furthermore, there is a heightened risk that the nib and/or feeding system of the pen may be damaged due to repeated handling by the user.

Thus, despite the convenience associated with using ink cartridges and converters (hereinafter referred to as ink reservoir units), there remains a need for a safer, more effective, and more user-friendly means of inserting and removing them in such fountain pens.

SUMMARY OF THE INVENTION

The present invention provides such a tool for facilitating the insertion and removal of ink reservoir units such as cartridges and converters from associated writing instruments.

In one aspect, the tool facilitates the insertion and removal of an ink reservoir unit from a chamber of a writing instrument, the chamber being located within a drum that is coupled to a nib of the writing instrument. The tool comprises a main section defining, at least in part, an internal cavity for receiving the nib. The tool is selectively configurable in a closed state and an open state. In the closed state, the nib is positioned inside the cavity and the tool clutches a grip portion of the writing instrument that is rigidly coupled to the nib and the drum. In the open state, the cavity is partially open, in comparison to when the tool is in the closed state, which thereby facilitates safe placement of the nib inside the cavity.

Preferably, the tool further comprises a closure element that, in the closed state of the tool, defines the internal cavity together with the main section of the tool, the closure element being positionable in a first position corresponding to the closed state of the tool and in a second position corresponding to the open state of the tool. The closure element may pivot on the main section such that the closure element lies against the main section when in the first position and the closure element lies away from the main section when in the second position. The closure element also preferably pivots about an axis that is perpendicular to a longitudinal direction of the main section. In one embodiment, the main section has a closed base at a first end of the tool, and the main section has a first rim and the closure element has a second rim such that, when the tool is in the closed state, the first and second rims are positioned together to form an opening to the cavity at a second end of the tool. In this manner, when the tool is in the closed state, the first and second rims are operable to be biased together in order to clutch the outer surface of the grip portion of the writing instrument. The tool may also further comprise a locking ring that is slidable along an external surface of the tool when the tool is in the closed state, the locking ring being selectively positionable so as to maintain the closure element in the first position.

In another aspect, the present invention provides a writing instrument compatible with such a tool. The writing instrument comprises a barrel, a nib, a drum defining a chamber therewithin, and a grip portion. The drum is coupled to the nib and is located inside the barrel when the writing instrument is assembled and operational. The grip portion is rigidly coupled to the nib and the drum, the grip portion being located outside the barrel and having an outer surface of a size and shape that are compatible with a part of the tool that is operable to clutch the grip portion. Preferably, the grip portion, the nib and the drum are separable from and reattachable to the barrel by way of a screw-on connection, the tool facilitating said separation and reattachment.

In yet another aspect, the present invention provides a method of using such a tool to facilitate the removal or insertion of an ink reservoir unit from a chamber within a drum of such a writing instrument. The method comprises: configuring the tool into an open state in which the cavity is partially open in comparison to when the tool is in a closed state; placing the nib inside the cavity; configuring the tool into the closed state in which the tool clutches a grip portion of the writing instrument that is rigidly coupled to the nib and the drum; and maneuvering the tool in order to separate the grip portion, the nib and the drum from the barrel of the writing instrument. The method may further comprise, once the drum has been separated from the barrel, removing an ink reservoir unit from the chamber and/or placing an ink reservoir unit in the chamber; and then maneuvering the tool in order to reattach the grip portion, the nib and the drum to the barrel. Placing the nib inside the cavity may also include aligning the tool with markings on an outer surface of the grip portion of the writing instrument.

Additional features of the present invention are described further below.

BRIEF DESCRIPTION OF THE DRAWINGS

The objects and advantages of the present invention will be better understood and more readily apparent when considered in conjunction with the following detailed description and accompanying drawings which illustrate, by way of example, preferred embodiments of the invention and in which:

FIG. 5 is a perspective view illustrating removal of an ink reservoir unit after the nib has been separated from the barrel of the writing instrument;

FIG. 6 is a perspective view illustrating the insertion of an ink reservoir unit before reconnection of the nib to the barrel;

FIG. 7 is a perspective view illustrating rotation of the tool to reconnect the nib to the barrel and thereby introduce an ink reservoir unit into the writing instrument; and FIG. 8 is a side view of the tool in an open position on the nib of the writing instrument after reconnection of the nib.

DETAILED DESCRIPTION OF PREFERRED EMBODIMENTS

Figure 1A:
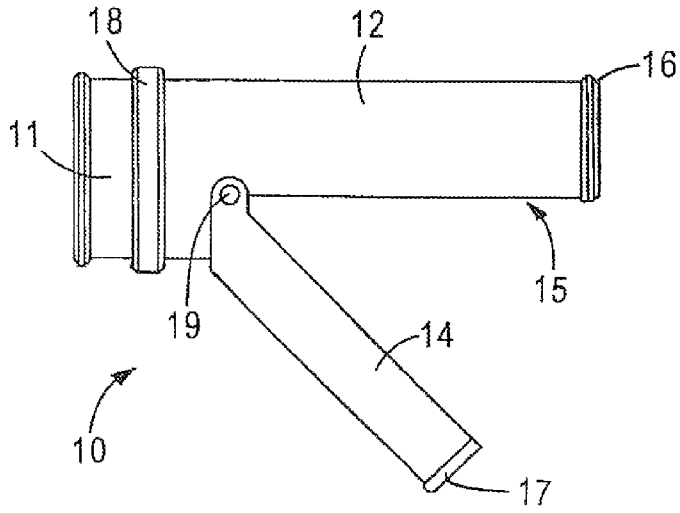
FIG. 1A is a side view of a tool for facilitating the replacement and/or refilling of ink in a writing instrument according to a preferred embodiment.
Figure 1B:
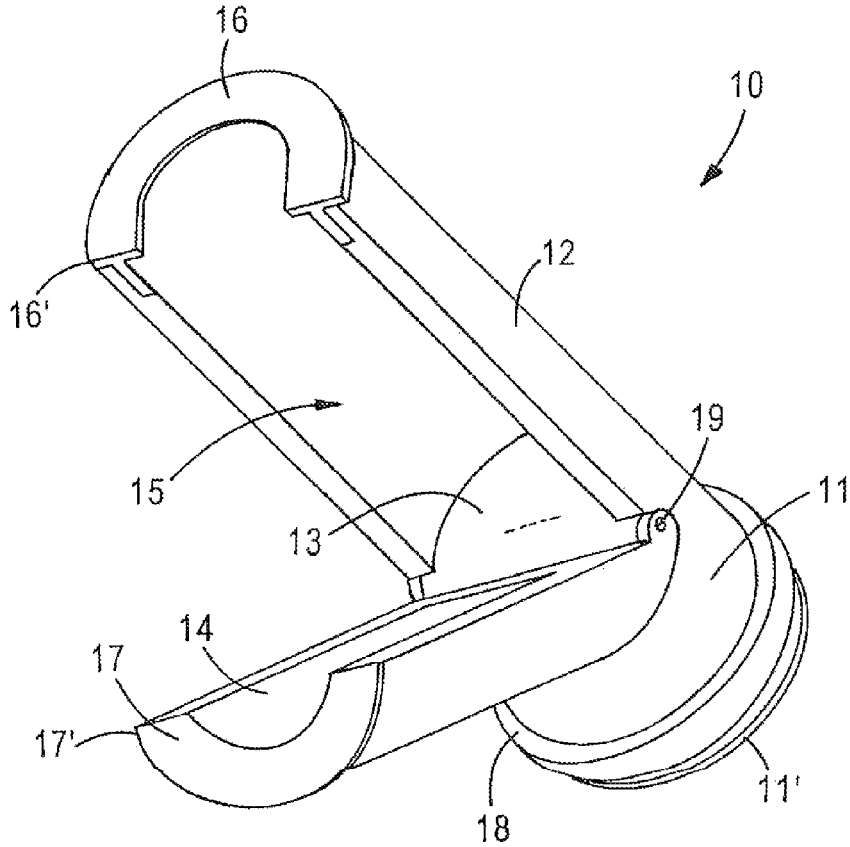
FIG. 1B is a perspective view of the tool in FIG. 1A.

In accordance with an illustrated embodiment of the present invention, FIGS. 1A and 1B are, respectively, side and perspective views of a tool 10 for facilitating the insertion and removal of an ink reservoir unit such as a cartridge or a converter from a writing instrument 20. Writing instrument 20 is typically a fountain pen and the terms 'pen' and 'writing instrument' are used interchangeably herein.

As will be described below, FIGS. 2-8 illustrate the use of tool 10 to facilitate the removal and replacement of an ink reservoir unit 40 within pen 20.

As shown, pen 20 includes an elongated barrel 22, a nib 24, and a nib section block 26. Nib section block 26 comprises a coupling band 28 that is rigidly connected to the base of nib 24 and a drum 29 having a reservoir chamber 30 for holding an ink reservoir unit, such as a cartridge. Block 26 also comprises part (not shown) of an ink-feeding system that feeds ink into the nib. The ink-feeding system may, for example, be capillary-based, and nib 24 may include comb serrations 25 to facilitate the flow of ink to its tip. In known manner, when pen 20 is fully assembled and operable to write, drum 29 is housed within barrel 22 and holds the ink reservoir unit in fluid connection with the feeding system. In the illustrated embodiment, barrel 22 has a tapered and slightly curved shape, but various different barrel shapes are possible.

In order for a user to gain access to chamber 30 to replace or refill an ink reservoir unit 40, the nib 24 and nib block section 26 (which, as indicated, are held firmly together) must first be unscrewed, or otherwise separated, from barrel 22. In accordance with the present invention, tool 10 greatly facilitates this task and also serves to protect nib 24 during this process.

As shown in FIGS. 1A and 1B, tool 10 includes a main body section 12 having a closed base 11 at one end. At base 1, main section 12 has a generally cylindrical shape, but the remainder of section 12 has a generally semi-circular or "C-shaped" sectional shape, the internal surface of which defines, in part, an elongated cavity 15 inside tool 10. As described further below, cavity 15 is appropriately sized to safely house the nib 24 of pen 20. The body of tool 10 also includes a closure element 14 that, in the illustrated embodiment, pivots on section 12 about an axis 19. This axis is preferably perpendicular to the longitudinal direction of main section 12 as shown. By pivoting closure element 14 away from main section 12, tool 10 can be placed in an open state (FIGS. 1A, 1B, 2); and by pivoting closure element 14 so that it lies against main section 12, tool 10 can be placed in a closed state (FIGS. 3-7). When tool 10 is in a closed state, the internal surface of closure element 14, which also has a generally semi-circular or "C-shaped" sectional shape, defines the remainder of cavity 15. As shown, the entirety of tool 10 preferably takes on a generally cylindrical shape in its closed state. Also in the closed state, rims 16 and 17 of section 12 and element 14 respectively, which are located at the opposite end of tool 10 from base 11, together provide a generally circular opening to cavity 15. In this manner, tool 10 provides an elongated cavity 15 that is bounded lengthwise by the internal surfaces of section 12 and element 14 and internally by an inner face 13 of base 11.

In a preferred embodiment, tool 10 further includes a locking ring 18 that is slidable along the external surfaces of section 12 and element 14 when the tool is in the closed state. Base 11 and rims 16, 17 preferably have outward flanges 11' and 16', 17' respectively that help to ensure that ring 18 remains engaged on tool 10 and does not slide off.

Figure 2:
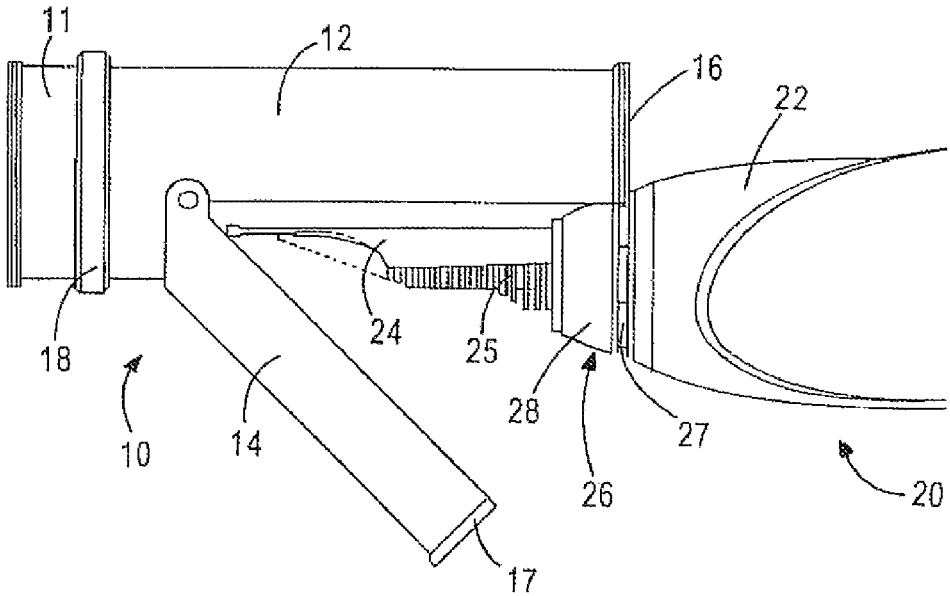
FIG. 2 is a side view of the tool in an open state on the nib of a writing instrument prior to the removal of an ink reservoir unit housed within the instrument.

The operation of tool 10 to carry out the removal and replacement of an ink reservoir unit in pen 20 will now be described. Initially, tool 10 is placed in an open state by ensuring that locking ring 18 is positioned near the base end of tool 10 and closure element 14 has pivoted away from main section 12. Closure element 14 is preferably freely pivotable such that it may swing into an open position when there is no force biasing it against main section 12. As shown in FIG. 2, nib 24 is then placed inside tool 10 and notably cavity 15, which is partially open in this state (in comparison with the closed state). Since tool 10 is in an open state, the nib can be safely placed into cavity 15 with minimal risk of damage or harm.

In addition, to ensure proper positioning between tool 10 and pen 20 and notably that nib 24 is not inserted too far within tool 10 (such that a sufficiently safe space remains between the tip of the nib and internal cavity wall 13), band 28 preferably has markings 27 on its surface that are aligned with rim 16 of main section 12 during the insertion of the nib.

Figure 3:
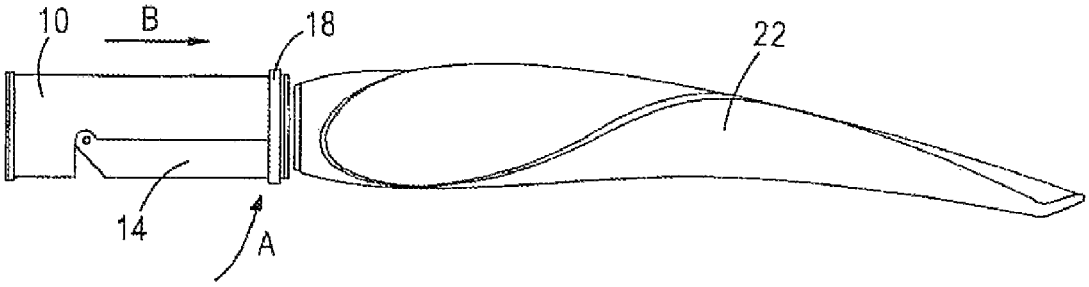
FIG. 3 is a side view of the tool in a closed state on the nib of the writing instrument.
Figure 4:
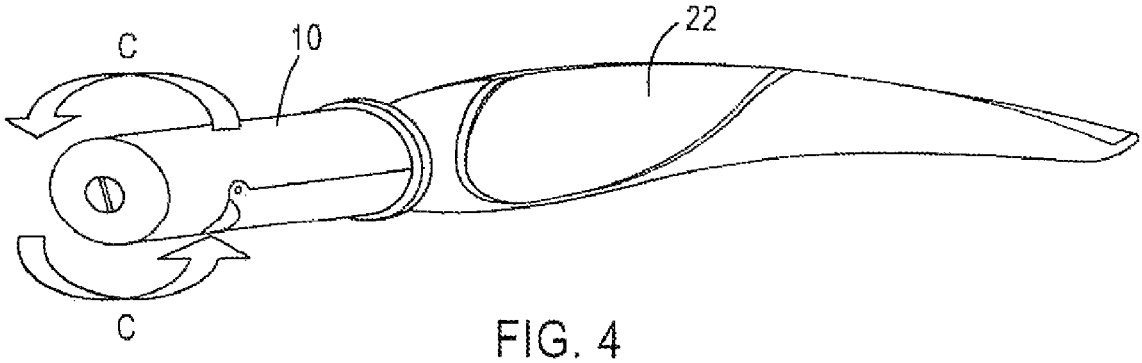
FIG. 4 is a perspective view illustrating rotation of the tool to separate the nib from the barrel of the writing instrument, in order to enable the removal of an ink reservoir unit.

Next, as shown in FIG. 3, closure element 14 is rotated shut against main section 12 (arrow A) so as to close tool 10. Locking ring 18 is then slid along tool 10 toward pen 20 until the ring abuts or almost abuts against the flanges 16', 17' of rims 16, 17. In this position, tool 10 is locked, and due to the action of ring 18 (and/or optionally force exerted by a user) the rims 16, 17 are biased firmly together so that they clutch or grip the outer surface of band 27. In this manner, tool 10 clutches band 27—and with it, nib 24 and the rest of section block 26—with sufficient force to maneuver the latter as required. In particular, as indicated in FIG. 4, by rotating tool 10 in a counter-clockwise direction (arrows C), the nib and section block can be unscrewed and separated from barrel 22. Optionally, the inner surfaces of the rims 16, 17 and the outer surface of band 27 may be provided with complementary facets or profiles to improve their engagement with one another.

Once nib 24 and section block 26 have been separated from barrel 22, the reservoir chamber 30 within block 26 becomes readily accessible, as does the empty ink reservoir unit 40 within the chamber. As a result, the empty ink reservoir unit can be easily pulled out and removed by a user, as illustrated by arrow D in FIG. 5. Next, as shown at arrow E in FIG. 6, a replacement or refilled ink reservoir unit 40' is inserted into chamber 30 by the user. In known manner, where unit 40' is an ink cartridge, it must be pushed into chamber 30 firmly so that the cartridge's seal is broken and ink is able to flow from the cartridge into the feeding system of the pen.

Tool 10 is then used again to reconnect nib 24 and section block 26 to the barrel 22 of the pen. In particular, as indicated in FIG. 7, by rotating tool 10 in a clockwise direction (arrows F), the nib and section block are reunited with barrel 22 so that pen 20 is once again operational. Finally, to remove tool 10 from the pen, locking ring 18 is slid away from the pen towards the base 11 of the tool (arrow G in FIG. 8), and closure element 14 is pivoted away from main section 12, so that nib 24 can be safely removed from cavity 15 of the tool.

Since the nib is held firmly and securely inside tool 10 throughout, there is no risk of damage to the nib while an ink reservoir unit is being replaced or refilled. In addition, as the nib does not need to be directly handled by the user, the user conveniently avoids staining his or her hands with ink during this process. In addition, the tool is significantly easier to grip and manipulate in comparison to the pen's nib, thereby rendering the entire refill process much less awkward and much more convenient. In that connection, portions (e.g., opposing sides) of the external surface of main 12 and/or closure element 14 may be slightly flattened and/or ridged to enable a user's fingers to obtain a better grip on the tool.

It will be appreciated that various alternatives are possible in terms of the shape and structure of the tool so long as: in a closed state, the tool securely encases the nib and is operable to clutch or grip the nib and section block with sufficient force to maneuver the latter as required; and, in an open state, the tool facilitates the safe placement of the nib inside its cavity. For example, the closure element 14 could pivot about an axis that is parallel to the longitudinal direction of main section 12. Alternatively, instead of pivoting between open and closed positions, the closure element could slide between open and closed positions along the outer (or inner) surface of main section 12. Such a sliding motion could occur in either a longitudinal direction or a circumferential direction with respect to the tool's body. As a further example, the closure element 14 could be dispensed with, and the tool may clutch the section block similar to a spring clamp, with a user being able to manipulate the tool's main body so that the opening to cavity 15 selectively expands (in effect, partially opens) and contracts to place the tool in the open and closed states respectively.

In general, while the invention has been described in conjunction with specific embodiments, it is evident that numerous alternatives, modifications, and variations will be apparent to those skilled in the art in light of the foregoing description. For example, tool 10 may form part of a cap for the writing instrument. Depending on the specific design of the pen, the tool may also clutch or grip a portion of the pen other than band 28. The locking ring 18 could be dispensed with, or it may be replaced by another type of locking mechanism that helps to keep the tool in a closed state (e.g., a spring bias device). Additionally, the tool may be used with pens where, instead of a screw-on connection, another type of releasable fastening connection is used between the nib/block and the barrel of the pen. What remains important is that the tool securely encases the nib and facilitates the release and reconnection of the nib/block from and to the barrel.

The invention claimed is:

1. A tool for facilitating the insertion and removal of an ink reservoir unit from a chamber of a writing instrument, the chamber being located within a drum that is coupled to a nib of the writing instrument, the tool comprising:

a body having means for receiving the nib;

means for selectively configuring the tool in one of i) an open state in which the tool is configured to facilitate safe placement of the nib inside the nib receiving means, and ii) a closed state in which the nib receiving means are configured to enclose the nib;

means for, when the tool is in the closed state, clutching a portion of the writing instrument that is rigidly coupled to the nib and the drum; and locking means, slidable along the body of the tool, for selectively maintaining the tool in the closed state.

2. A tool for facilitating the insertion and removal of an ink reservoir unit from a chamber of a writing instrument, the chamber being located within a drum that is coupled to a nib of the writing instrument, the tool comprising:

a main section;

a closure element connected to the main section and movable with respect to the main section between a first position and a second position, the main section and the closure element in the first position forming a closed state with i) an internal cavity formed inside the main section and the closure element, and ii) an external surface formed along an outside of the closure element and the main section; and a locking element slidable along the external surface of the main section and the closure element in the closed state, the locking element being selectively positionable to maintain the closure element in the first position, wherein the main section and the closure element in the closed state is further configured to clutch a grip portion of the writing instrument rigidly coupled to the nib and the drum of the writing instrument, and wherein the main section and the closure element in the second position form an open state with the internal cavity being open so to facilitate safe placement of the nib inside the cavity.

3. The tool according to claim 2, wherein the closure element is configured to pivot on the main section such that the closure element lies against the main section when in the first position and the closure element lies away from the main section when in the second position.

4. The tool according to claim 2, wherein the closure element pivots about an axis that is perpendicular to a longitudinal direction of the main section.

5. The tool according to claim 2, wherein the main section has a closed base at a first end of the tool, and wherein the main section has a first rim and the closure element has a second rim such that, when the tool is in the closed state, the first and second rims are positioned together to form an opening to the cavity at a second end of the tool.

6. The tool according to claim 5, wherein, when the tool is in the closed state, the first and second rims are operable to be biased together in order to clutch an outer surface of the grip portion of the writing instrument.

7. The tool according to claim 6, wherein inner surfaces of the first and second rims that engage with the outer surface of the grip portion have profiles that are complementary to a profile of said outer surface of the grip portion.

8. The tool according to claim 6, wherein the grip portion is a coupling band that is rigidly connected to a base of the nib.

9. The tool according to claim 2, wherein the main section has a closed base at a first end of the tool, and wherein the main section has a first rim and the closure element has a second rim such that, when the tool is in the closed state, the first and second rims are positioned together to form an opening to the cavity at a second end of the tool and are operable to be biased together in order to clutch the outer surface of the grip portion of the writing instrument, and wherein the base, the first rim and the second rim comprise outwardly extending flanges for ensuring that the locking element remains engaged on the tool.

10. A method of using a tool to facilitate the removal or insertion of an ink reservoir unit from a chamber within a drum of a writing instrument, the drum being coupled to a nib of the writing instrument and the writing instrument having a barrel configured to receive the drum and couple with the nib, the tool comprising a main section defining, at least in part, an internal cavity for receiving the nib, and a locking element slidable along the main section, the method comprising:

opening the tool into an open state in which the cavity is partially open in comparison to when the tool is in a closed state;

placing the nib inside the cavity;

closing the tool into the closed state such that the tool clutches a grip portion of the writing instrument rigidly coupled to the nib and the drum;

sliding the locking element of the tool along the main section of the tool so that the locking element maintains the tool in the closed state; and maneuvering the tool to separate the grip portion, the nib and the drum from the barrel of the writing instrument.

11. The method according to claim 10, further comprising:

upon separation of the nib and drum from the barrel, at least one of i) removing the ink reservoir unit from the chamber and ii) placing a new ink reservoir unit in the chamber; and maneuvering the tool in order to reattach the grip portion, the nib and the drum to the barrel.

12. The method according to claim 11, wherein the grip portion, the nib and the drum are separable from and reattachable to the barrel by way of a screw-on connection, wherein the maneuvering the tool in order to separate the grip portion, the nib and the drum from the barrel step comprises the sub-step of rotating the tool in a first direction, and wherein the maneuvering the tool in order to reattach the grip portion, the nib and the drum to the barrel step comprises rotating the tool in a second direction.

13. The method according to claim 10, wherein placing the nib inside the cavity includes the sub-step of aligning the tool with markings on an outer surface of the grip portion of the writing instrument.

* * * * *